United States Patent [19]

Snyder

[11] 4,402,171

[45] Sep. 6, 1983

[54] CEILING GRID BRACKET

[76] Inventor: David R. Snyder, 120 Key Crt., Hurst, Tex. 76053

[21] Appl. No.: 341,797

[22] Filed: Jan. 22, 1982

[51] Int. Cl.[3] ..... E04B 1/00

[52] U.S. Cl. ..... 52/741

[58] Field of Search ..... 52/712, 484; 52/241, 52/488, 741; 403/400, 387, 398

[56] References Cited

U.S. PATENT DOCUMENTS

| | | | |
|---|---|---|---|
| 2,843,230 | 7/1958 | Nelsson | 403/387 |
| 3,187,854 | 6/1965 | Lydard | 403/387 |
| 3,608,263 | 9/1971 | Gartner | 52/712 |
| 3,619,960 | 11/1971 | Thompson | 52/484 |
| 3,748,793 | 7/1973 | Tompkins et al. | 52/484 |
| 3,843,086 | 10/1974 | Ptak | 52/484 |
| 3,986,314 | 10/1976 | Moeller | 52/484 |
| 4,021,986 | 5/1977 | McCall et al. | 52/484 |
| 4,040,758 | 8/1977 | Sauer | 403/398 |
| 4,081,931 | 4/1978 | Miyoshi | 52/484 |
| 4,277,920 | 7/1981 | Dixon | 52/241 |

*Primary Examiner*—John E. Murtagh
*Assistant Examiner*—Michael Safavi
*Attorney, Agent, or Firm*—James E. Bradley

[57] ABSTRACT

A device is shown for securing the base portion of a channel member of the type used to support a partition in a building to a ceiling grid structure. The device includes a bracket which is received on the ceiling structure. The channel member is secured to the bracket to support the channel member from the ceiling grid structure without damaging or contacting the ceiling grid structure itself. The bracket is then fastened to the ceiling grid structure to prevent transverse movement of the channel member along the ceiling grid structure. That portion of the ceiling grid structure which is visible within the completed building interior is not damaged when the partition is removed or relocated.

2 Claims, 3 Drawing Figures

33
31
29
35
19
17
15
43
45
11
13
47
37

51
59
49
11
57
21
63
39
61
35
53
23
33
25
55

CEILING GRID BRACKET

BACKGROUND OF THE INVENTION

This invention relates generally to building interior finish devices and techniques and specifically to a device for securing a metal channel member of the type used to support interior partitions to a ceiling grid structure.

In modern construction and interior finishing techniques, it is desirable to provide means for erecting interior walls or partitions which allow the wall or partition to be easily moved to a new location within the building or removed entirely. In this way, the size of a given room within the building interior can be enlarged or decreased with a minimum amount of time and expense. This is especially useful in the commercial office rental situation where businesses are constantly expanding and desire to take in more space.

In order to facilitate wall erection or relocation, modern construction techniques provide for a framework or grid structure to be erected in the ceiling of the building interior. The grid consists of a series of parallel and transverse metal beams arranged in a common plane and supported from ceiling trusses or the like. The ceiling grid structure is used to support ceiling panels such as acoustical panels to provide a finished appearance to the interior of the building. In addition, the ceiling grid structure is used to provide support for a channel member which in turn receives and supports vertically the room partition being erected.

In the past, the channel member was supported from the ceiling grid structure by metal screws which were run through the channel member and through the ceiling grid beam directly above. Because ease of removal and relocation of the channel member and hence the room partition is one of the chief objectives of this interior finishing technique, it was desirable to avoid marring or detracting from the appearance of the ceiling grid which is visible from the interior of the room. Thus, under the prior practice, when the wall was removed or relocated, the holes left by the metal screws were visible in the ceiling grid structure which was left behind.

SUMMARY OF THE INVENTION

The present invention is a device for securing the base portion of a channel member of the type used to support a partition in a building to a ceiling grid structure. The device includes a bracket adapted to be received on the ceiling grid structure and mounting means for securing the channel member base portion to the bracket to thereby support the channel member from the ceiling grid structure. Fastening means are provided for preventing movement of the bracket and hence the channel member along the longitudinal axis of the ceiling grid structure.

Preferably, the bracket has a U-shaped central portion adapted to be received on the ceiling grid structure and oppositely facing flanges extending outwardly from the U-shaped central portion generally parallel to the plane of the base portion of the channel member. The fastening means preferably comprises a screw passing through the U-shaped portion of the bracket which is received on the ceiling grid structure. The mounting means are preferably screws which are passed between the channel member base portion and the bracket flanges without contacting the ceiling grid structure.

In the method of securing the base portion of a channel member to a ceiling grid structure the channel member is supported from the ceiling grid structure by means of a bracket having a U-shaped central portion adapted to be received on the ceiling grid structure and oppositely facing flanges extending outwardly from the U-shaped central portion generally parallel to the plane of the base portion of the channel member. Mounting means are passed through the channel member base portion and the bracket flanges to support the channel member without contacting the ceiling grid structure. Fastening means are then passed through the U-shaped portion of the bracket which is received on the ceiling grid structure to thereby prevent movement of the channel member along the ceiling grid structure.

Additional objects, features, and advantages will be apparent from the description which follows.

DETAILED DESCRIPTION OF THE INVENTION

Figure 1:
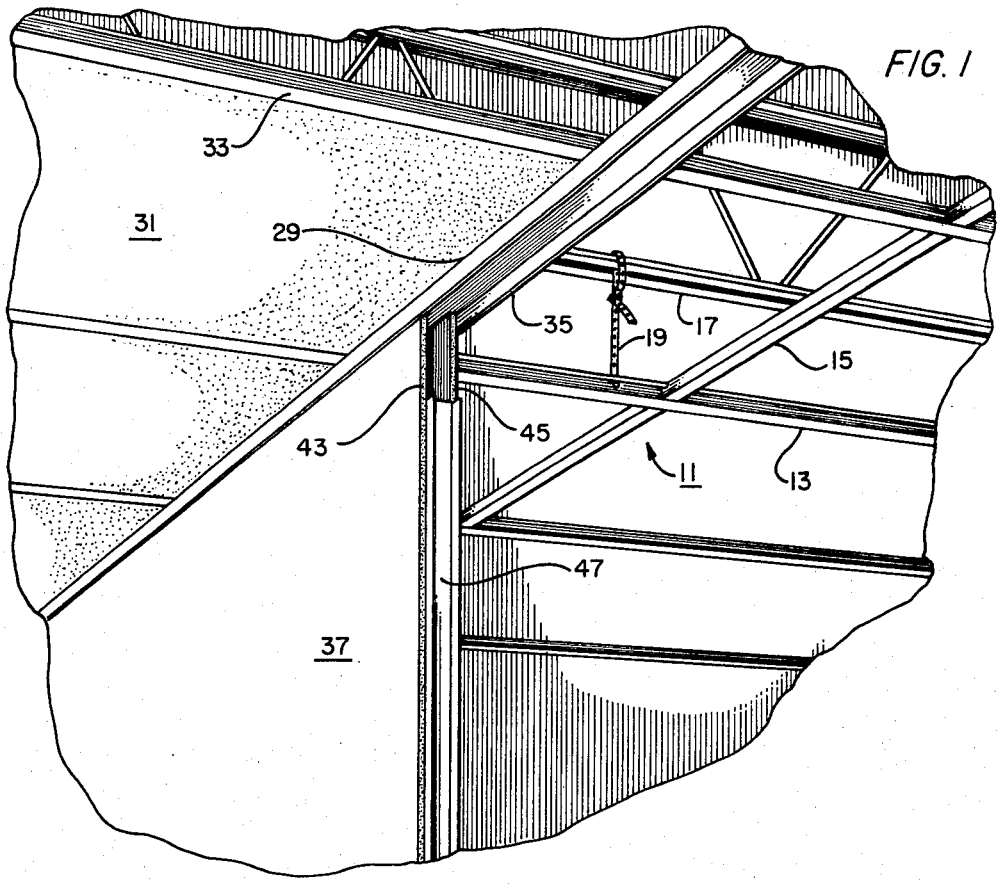
FIG. 1 is a perspective view of a ceiling grid structure showng a channel member of the type adapted to support a wall partition supported from the structure.

Turning to FIG. 1, there is shown a ceiling grid structure designated generally as 11. Grid structure 11 is made up of a series of parallel beams 13 and transverse beams 15 arranged to form a mesh or grid in a common plane supported from the ceiling trusses 17 as by adjustable bands 19.

Figure 3:
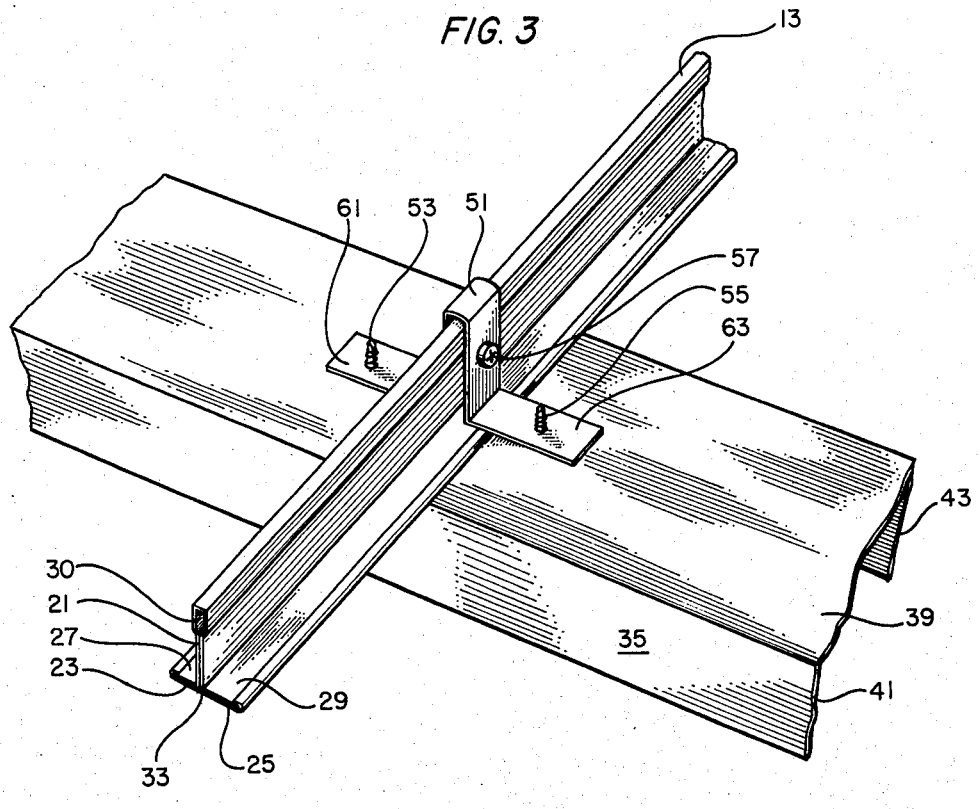
FIG. 3 is a close-up perspective view of a portion of the ceiling grid structure showing a portion of the channel member supported by the bracket of the invention.

As shown in FIG. 3, the grid beams 13, 15 are formed in the shape of an inverted "T" having a centrally located vertical flange 21 and oppositely facing horizontal flanges 23, 25. Vertical flange 21 has an enlarged recess 30 at the upper extent thereof which runs parallel to the plane of horizontal flanges 23, 25. The upper surfaces 27, 29 of horizontal flanges 23, 25 form oppositely facing ledges with respect to vertical flange 21 which are used to support the leading edge 32 (FIG. 1) of a ceiling panel 31. As shown in FIG. 1, the lower surface 33 of beams 13,15 is visible from the interior of the finished room when the ceiling panels 31 and the wall partition 37 are in place.

As best seen in FIGS. 1 and 3, the ceiling grid structure 11 is used to support a channel member 35 of the type adapted to support a partition 37 in a building. Channel member 35 is conveniently a metal member having a base portion 39 and sidewalls 41, 43. Additional depending sidewalls (not shown) can be provided between sidewalls 41, 43 and parallel thereto within channel member 35 depending upon the construction techniques being utilized. In the particular construction technique illustrated in FIG. 1, two identical wallboards 43, 45 are supported in vertical fashion within channel member 35 where they are maintained in tension by a vertical spacer 47. The channel member 35 may run transverse to the longitudinal axis of the ceiling grid structure to which the channel member 35 is secured as shown in FIG. 1, or it may run parallel.

Figure 2:
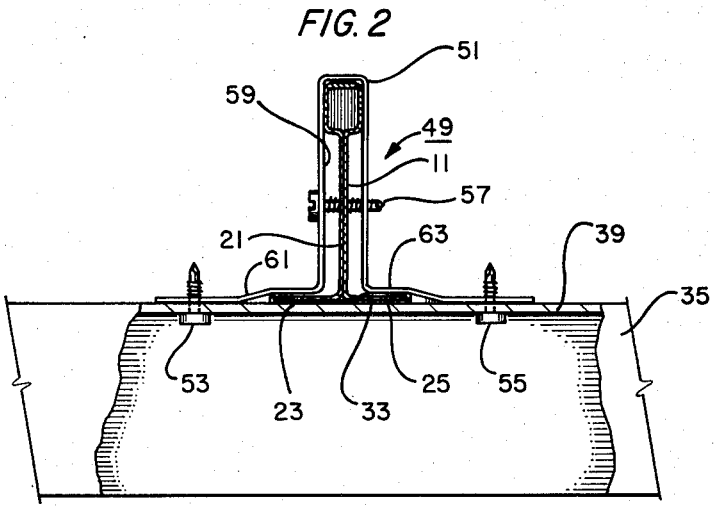
FIG. 2 is a side cross-sectional view of the channel member of FIG. 1 showing the bracket used to support the channel member from the ceiling grid structure.

In the past, the channel member 35 was supported from the ceiling grid structure 11 by screwing a metal screw through the base portion 39 of the channel member directly into the lower surface 33 of the ceiling beam 13. FIG. 2 shows a device designated generally as 49 of the present invention for securing the base portion 39 of a channel member 35 to a ceiling grid structure 11 of the kind used to support a partition in a building. The device 49 includes a bracket 51 which is adapted to be received on the ceiling grid structure 11. A pair of metal screws 53, 55 comprise mounting means for securing the channel member base portion 39 to the bracket 51 to thereby support the channel member 35 from the ceiling grid structure 11. A horizontal screw 57 passing through the U-shaped portion of bracket 51 and the vertical flange portion 21 of ceiling grid structure 11 comprises fastening means for preventing movement of bracket 51 and hence channel member 35 along the longitudinal axis of ceiling grid structure 11.

As shown in FIG. 2, bracket 51 preferably has a U-shaped central portion 59 adapted to be received on the vertical flange 21 of ceiling grid structure 11 and oppositely facing flanges 61, 63 extending outwardly from U-shaped central portion 59 generally parallel to the plane of the base portion 39 of channel member 35 when the channel member is in position to be secured to the ceiling grid structure 11. Screws 53, 55 are spaced-apart from horizontal flanges 23, 25 of ceiling grid structure 11 and pass between channel member base portion 39 and bracket flanges 61, 63 without contacting the ceiling grid structure 11.

Although other mounting and fastening means can be utilized, mounting means 53, 55 and fastening means 57 are preferably selectively removable to allow channel member 35 to be repositioned on ceiling grid structure 11 with a minimum of effort.

In the method of securing the base portion 39 of a channel member 35 to a ceiling grid structure 11, the channel member 35 is supported from the ceiling grid structure 11 by means of a bracket having a U-shaped central portion 59 adapted to be received on the ceiling grid structure 11 and oppositely facing flanges 61, 63 which extend outwardly from the U-shaped central portion generally parallel to the plane of the base portion 39 of the channel member 35. After the U-shaped portion 59 of bracket 51 is passed over the ceiling grid structure 11 and the channel member 39 is moved into position immediately below flanges 61, 63 of bracket 51, metal screws 53, 55 are passed through the base portion 39 and through bracket flanges 61, 63 without contacting the lower surface 33 of ceiling grid structure 11. A horizontally oriented screw 57 is then passed through the U-shaped portion 59 of bracket 51 which is received on ceiling grid structure 11 to thereby prevent movement of channel member 35 along the longitudinal axis of the ceiling grid structure 11.

An invention has been provided with significant advantages. In the past, the channel member of the type used to support a partition in a building was secured to the lower surface 33 of the ceiling grid structure by passing metal screws directly through the channel base portion 39 through the lower surface 33 of the ceiling grid structure 11. As a result, when the wall was removed or relocated, the holes left in the ceiling grid surface 33 had to be repaired or left an unsightly appearance. The improved mounting device of the invention provides a quick and convenient means for mounting the channel member 35 to the ceiling grid structure 11 without damaging the appearance of the grid structure when the device is removed or repositioned. The bracket is inexpensive in manufacture and can be installed with a minimum of additional effort.

While the invention has been shown in only one of its forms, it should be apparent to those skilled in the art that it is not thus limited but is susceptible to various changes and modifications without departing from the spirit thereof.

I claim:

1. A method of securing the base portion of a channel member to an exposed ceiling grid structure, said channel member being adapted to support a partition in the interior of a building, comprising the steps of:

providing a bracket having a U-shaped central portion adapted to be received on said ceiling grid structure and oppositely facing flanges extending outwardly from said U-shaped central portion generally parallel to the plane of the base portion of said channel member;

placing said bracket over said ceiling grid and placing said channel member below said bracket whereby said channel member crosses said ceiling grid in transverse fashion, the portion of the ceiling grid not traversed by said channel member being visible from the interior of said building when said bracket is in place;

passing mounting means through said channel member base portion and said bracket flanges without contacting said ceiling grid structure; and passing fastening means through said U-shaped portion of said bracket which is received on said ceiling grid structure to thereby prevent movement of said channel member along the longitudinal axis of said ceiling grid structure.

2. The method of claim 1, further comprising the steps of:

repositioning said channel member and partition within said building interior by removing said mounting means and fastening means and moving said channel member transversely along said ceiling grid; and passing mounting means upwardly through said repositioned channel member base portion and said bracket flanges without contacting said ceiling grid structure whereby the appearance of said ceiling grid which is visible from the interior of said building when said bracket is in place is not marred by said repositioning of said channel member.

* * * * *